US006513193B1

(12) United States Patent
Yezersky et al.

(10) Patent No.: US 6,513,193 B1
(45) Date of Patent: Feb. 4, 2003

(54) DOOR CHECK MECHANISM PROVIDING AN INFINITE NUMBER OF STABLE POSITIONS

(75) Inventors: Grigory Yezersky, Farmington Hills, MI (US); Gerald Cilibraise, Livonia, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 199 days.

(21) Appl. No.: 09/620,255

(22) Filed: Jul. 21, 2000

(51) Int. Cl.[7] ..... E05F 5/06
(52) U.S. Cl. ..... 16/86 C; 16/86 A; 16/86 B
(58) Field of Search ..... 16/86 C, 86 B, 16/85, 86 A, 82, 334; 296/146.12, 262, DIG. 61; 292/275, 262, 73, 75, DIG. 19

(56) References Cited

U.S. PATENT DOCUMENTS

| | | | | |
|---|---|---|---|---|
| 2,032,600 | A | | 3/1936 | Smith |
| 2,237,046 | A | | 4/1941 | Breitenwischer |
| 2,290,331 | A | | 7/1942 | Jacobs |
| 2,321,409 | A | | 6/1943 | Moore |
| 2,693,616 | A | | 11/1954 | Cormwell et al. |
| 2,724,143 | A | | 11/1955 | Galla |
| 2,787,019 | A | | 4/1957 | Galla |
| 2,860,369 | A | | 11/1958 | Galla |
| 2,980,945 | A | | 4/1961 | Hollar, Jr. |
| 3,012,269 | A | | 12/1961 | Bartel |
| 3,051,983 | A | | 9/1962 | Dale |
| 3,369,833 | A | | 2/1968 | Schaldenbrand |
| 3,643,289 | A | | 2/1972 | Lohr |
| 3,969,789 | A | * | 7/1976 | Wize |
| 3,979,790 | A | | 9/1976 | Chiarappa |
| 3,980,331 | A | | 9/1976 | Kennedy et al. |
| 4,048,695 | A | | 9/1977 | Juilfs et al. |
| 4,152,872 | A | * | 5/1979 | Tanizaki et al. |
| 4,194,264 | A | | 3/1980 | Stoffregen |
| 4,658,468 | A | | 4/1987 | Tillmann et al. |
| 4,663,801 | A | | 5/1987 | Malopolski, Jr. |
| 4,670,941 | A | | 6/1987 | Peterson |
| 4,672,715 | A | | 6/1987 | Beckwith |
| 4,692,960 | A | | 9/1987 | Jozefczak |
| 4,727,621 | A | * | 3/1988 | Emergy et al. |
| 4,738,003 | A | | 4/1988 | Mori et al. |
| 4,785,493 | A | | 11/1988 | Tillmann et al. |
| 4,788,743 | A | | 12/1988 | Okumura |
| 4,833,755 | A | | 5/1989 | Bonin |
| 4,841,600 | A | | 6/1989 | Sasamura et al. |
| 4,858,952 | A | | 8/1989 | Sasaki |
| 4,912,806 | A | | 4/1990 | Orii et al. |
| 5,074,010 | A | | 12/1991 | Gignac et al. |
| 5,112,091 | A | * | 5/1992 | Kluting |
| 5,152,030 | A | | 10/1992 | Cogo |
| 5,173,991 | A | | 12/1992 | Carswell |
| 5,361,540 | A | | 11/1994 | Rogers, Jr. et al. |
| 5,474,344 | A | | 12/1995 | Lee |
| 5,509,175 | A | | 4/1996 | Baughan et al. |
| 5,727,287 | A | | 3/1998 | Hosken et al. |
| 5,862,570 | A | | 1/1999 | Lezuch et al. |
| 5,896,704 | A | * | 4/1999 | Neag et al. |
| 6,065,185 | A | | 5/2000 | Breed et al. |
| 6,237,190 | B1 | | 5/2001 | Grumm et al. |

FOREIGN PATENT DOCUMENTS

| | | | |
|---|---|---|---|
| EP | 292683 | * | 4/1988 |

* cited by examiner

*Primary Examiner*—Anthony Knight
*Assistant Examiner*—Mark Williams
(74) *Attorney, Agent, or Firm*—Mark P. Calcaterra

(57) ABSTRACT

A checkstrap assembly is provided for a door of a vehicle. The checkstrap assembly includes an arm passing inside a channel. The arm has a first end rotatably mounted to the vehicle frame such that the door may be selectively moved relative to the arm. A roller is rotatably mounted on a second end of the arm and is received in the channel. A wedging device is disposed in the channel in association with the roller. The wedging device and roller engage one another under low boards to provide a locked condition at an infinite number of positions within the channel, and which can be overcome by application of a larger load.

18 Claims, 2 Drawing Sheets

DOOR CHECK MECHANISM PROVIDING AN INFINITE NUMBER OF STABLE POSITIONS

FIELD OF THE INVENTION

The present invention relates generally to articulating doors for motor vehicles, and more particularly to a checkstrap assembly operative to positively locate a passenger door of a motor vehicle between a fully open position and a closed position with an infinite range of positively located positions in between.

BACKGROUND

In a conventional manner, passenger doors of motor vehicles are pivotally mounted to the vehicle body for movement between a fully open and a closed position. Many such vehicle doors are designed to cooperate with a checkstrap which is operative for positively locating the vehicle door relative to the vehicle body. For example, the checkstrap is adapted to positively locate the vehicle door relative to the vehicle body at an intermediate position between a fully open and a closed position. In situations where a space laterally adjacent to a passenger door prohibits the door from fully opening, opening of the door to the intermediate position reduces incidents of unintentional damage to the door, to an adjacent vehicle, or both. In addition, on a sloped surface, the checkstrap provides a mechanism to hold the door in its open position.

In one common form, prior checkstraps for vehicle doors include a roller mounted to the vehicle door and an arm contoured to cooperate with the roller which is carried by the vehicle body. In this regard, the arm is formed to include one or more camming surfaces. The roller functions as a cam follower. As the door is moved between its fully opened position and its closed position, the arm remains in constant engagement with the roller. When the door is gently opened and closed, the cam surfaces of the arm and the roller cooperatively function to positively define an intermediate position at which the door may be located relative to the vehicle body.

In another known arrangement, a checkstrap arrangement includes a checking mechanism that cooperates with a link member. Such an arrangement is shown and described in U.S. Pat. No. 5,173,991 which is hereby incorporated by reference. While known arrangements have proven commercially acceptable, they are also limited with specific disadvantages, and thereby subject to improvement. In this regard, some known designs include only a limited number of positive positions between the fully open and closed position. In this case the door can be closed, open, or held only at one or two fixed intermediate locations. Therefore, not all possibilities as to open positions are available to the user of the vehicle. Furthermore, not all of the situations mentioned above may be remedied by such a limited number of positively held positions by the checkstrap.

SUMMARY OF THE INVENTION

It is an object of the present invention to provide a checkstrap that can create an infinite number of positively held positions between the fully open and closed position of an automobile door.

In order to obtain this object and other objects, the present invention provides a checkstrap assembly for a door of a vehicle which is movable in relation to a frame between an open position and a closed position. The checkstrap assembly includes an arm passing inside a channel. The arm has a first end connected to a roller in association with a wedging device inside the channel. The arm has a second end rotatably mounted on either the door or the frame such that movement of the door causes the arm and the channel to move relative to one another. The wedging device prevents relative movement between the arm and the channel until a sufficient force is applied to the door to overcome the wedging force.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
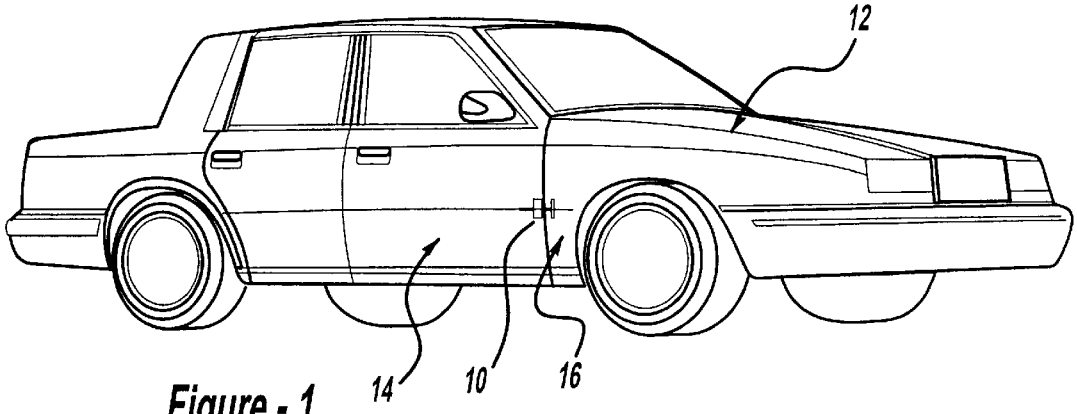
FIG. 1 is an environmental view of a checkstrap assembly constructed in accordance with the teaching of the preferred embodiment of the present invention and shown operatively installed within a vehicle so as to interconnect a passenger door with the body.

The present invention provides an improved checkstrap assembly specifically intended for use with a passenger door of a motor vehicle. With reference to the drawings, a checkstrap assembly constructed in accordance with the teachings of the present invention is illustrated and identified with reference numeral 10 in FIG. 1. The checkstrap assembly 10 is shown installed in a conventional vehicle 12. The checkstrap assembly 10 is fixedly mounted to interconnect the vehicle door 14 and the vehicle frame 16. The purpose of the checkstrap assembly 10 is to positively hold the vehicle door 14 in intermediate positions between a fully opened position and a closed position.

Figure 2:
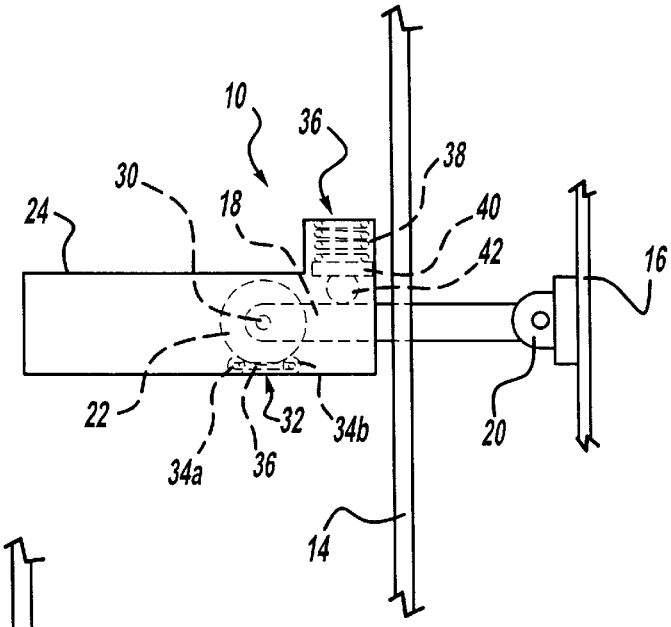
FIG. 2 is an enlarged view of the checkstrap assembly of FIG. 1 with the door structure removed for purposes of illustration in the preferred embodiment.

With reference to FIG. 2 the checkstrap assembly 10 is shown to generally include an arm 18 which has a first end which is hingedly connected to a mounting bracket 20. A roller 22 is rotatably mounted to a second end of the arm 18 which is received within a channel 24. In the preferred embodiment the channel 24 is attached to the inside of the vehicle door 14 while the mounting bracket 20 is attached to the outside of the vehicle frame 16. Further, the roller 22 is connected to the arm 18 with a mounting pin 30. The mounting pin 30 extends through a bore in the roller 22 and is fastened to. the arm 18 in a fashion to allow the roller 22 to rotate about the mounting pin 30.

The roller 22 sits in a wedging device 32. The wedging device 32 includes two small rollers 34*a,* 34*b* each having a diameter smaller than the diameter of the roller 22 connected to the arm 18. The wedging device rests on a bottom surface of channel 24 The small rollers 34*a,* 34*b* are connected to and held spaced apart by a connector bar 36. The roller 22 is held in the wedging device 32 by a spring device 36 that biases the arm 18 and roller 22 into the wedging device 32. The spring device 36 in a first embodiment includes a compression spring 38, a guide member 40, and a ball 42. In the spring device 36 the compression spring 38 provides a constant pressure on the arm 18 through the guide member 40 and the ball 42. Therefore, the arm 18 holds the roller 22 against the wedging device 32. The mounting bracket 20 allows the arm 18 to move in both vertical and horizontal directions. This movement can be accomplished in connecting the arm 18 by a ball joint and connecting the ball joint to the mounting bracket 20.

Figure 3:
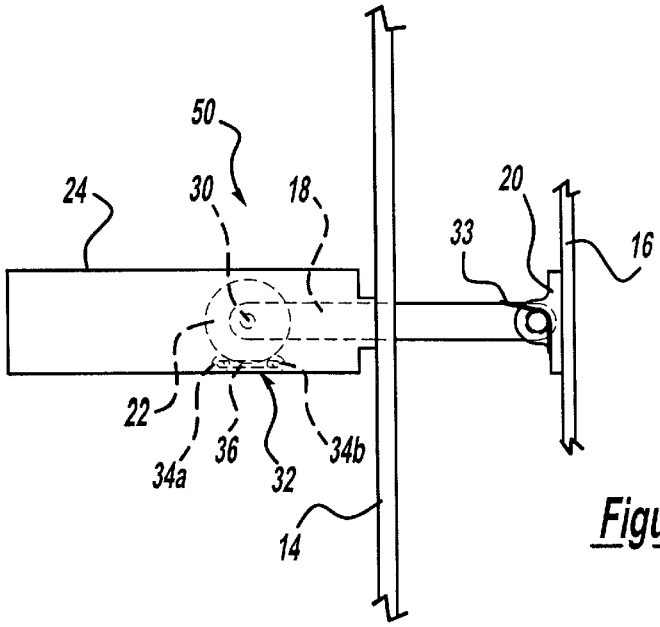
FIG. 3 is an enlarged view of the checkstrap assembly of FIG. 1 with the door structure removed for purposes of illustration of an alternate embodiment.

FIG. 3 shows an alternate embodiment of the checkstrap assembly 50 wherein like reference numerals designate common elements previously described. In this embodiment in place of the spring device 36 of FIG. 2 a biasing spring 33 is connected to the mounting bracket 20 and in contact with the arm 18. Therefore, the spring 33 biases the arm 18 towards the wedging device 32 with only one piece.

Figure 4:
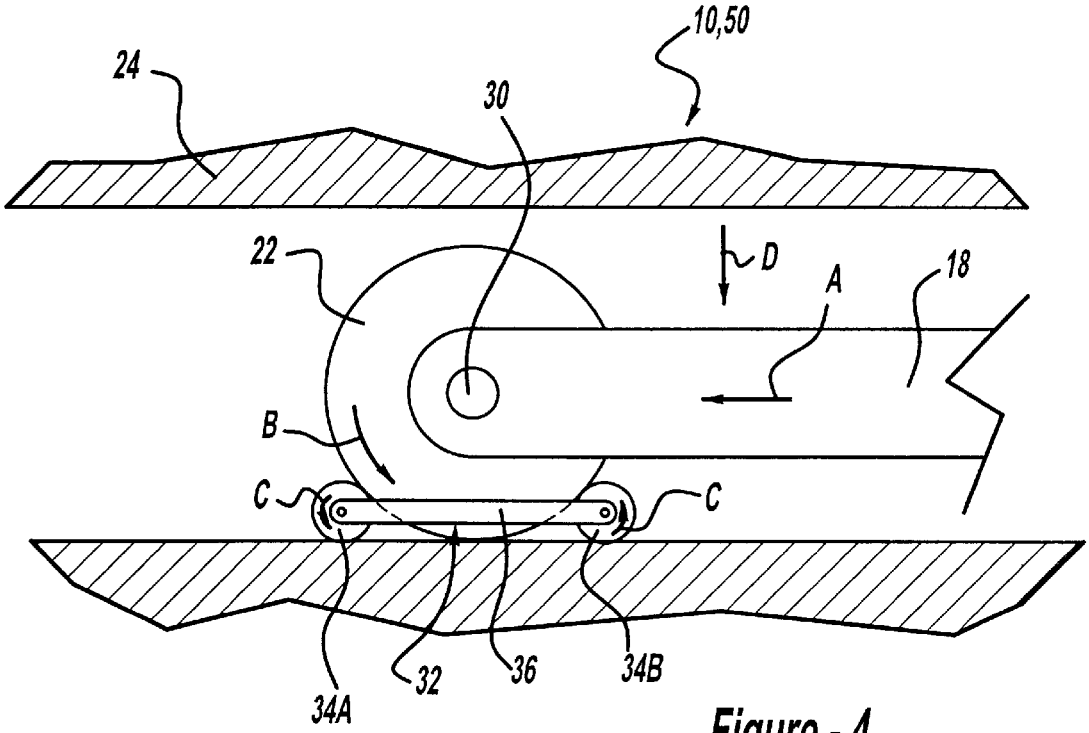
FIG. 4 is a further enlarged view of the checkstrap assembly of FIG. 1 showing greater detail of the channel and first end of the checkstrap arm in the locked position.

With continuing reference to FIGS. 2–5 the operation of the checkstrap assemblies 10, 50 is disclosed. FIG. 4 shows the roller 22 of the checkstrap assemblies 10, 50 in the locked position. Arrow A shows the force of the door 14 alone in a particular direction. The force indicated by arrow A will be called the small or locking force. When the force placed upon the arm 18 is only a small force A then the roller 22 remains in the wedging device 32 and stops the door 14 from moving. This is accomplished by the contrary direction of rotation of the roller 22 and the small rollers 34A, 34B of the wedging device 32. Arrow B shows the direction of rotation of the roller 22 while arrow C shows the direction of rotation of the small rollers 34A, 34B if the small force is in the direction indicated by the arrow A. The rotational direction of the roller 22, indicated by arrow B, is in the opposite direction to the rotational direction, indicated by arrow C, of the small rollers 34A, 34B. Therefore, a wedging affect occurs between the roller 22 and the wedging device 32 such that the checkstrap assembly will not move. The spring device 38 or 33 that biases the arm 18 provides the force illustrated by arrow D and the connector 36 holds the small rollers 34A, 34B in a constant orientation to one another.

Figure 5:
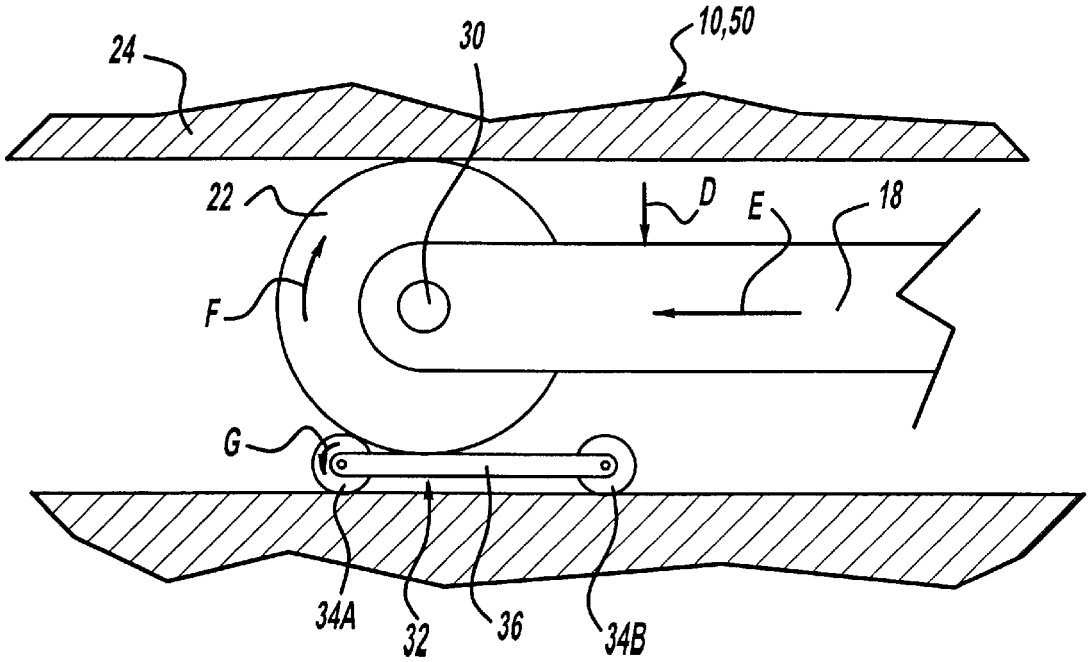
FIG. 5 is a further enlarged view of the checkstrap assembly of FIG. 1 showing greater detail of the channel and first end of the checkstrap arm in the unlocked position.

FIG. 5 shows the checkstrap assembly 10, 50 in its unlocked position. Here the locking force A is replaced by a larger unlocking force indicated by arrow E. This occurs when the door is acted upon by a force to open the door or close it. As this larger unlocking force E is applied the biasing force D is overcome and the roller 22 moves out from between the rollers 34A, 34B of the wedging device 32. The roller 22 then is in contact with an opposing side of the channel 24 and has a rotational direction as indicated by arrow F. The roller 22 is also in contact with only one small roller 34A of the wedging device 32. The rotational direction of the small roller 34A is indicated by arrow G. As indicated by the arrows F and G the rotational directions of the roller 22 and small roller 34A are no longer rotationally opposed, but rather they are complimentary allowing free movement of the checkstrap assembly 10, 50 through the channel 24.

Therefore, as long as the force applied to the arm 18 is large enough to overcome the biasing force D applied by the spring, the checkstrap assembly 10, 50 can move freely within the channel 24. Then when the force applied to the arm 18 becomes less than or equal to the locking force A the roller 22 moves back in between the rollers 34A, 34B of the wedging device 32 and the checkstrap assembly 10, 50 is locked. This locking and unlocking can occur at any place within the channel 24 thus allowing an infinite number of locking positions.

The invention being thus described, it will be obvious that the same may be varied in many ways. For example, channel 24 can be provided without an upper surface if a some other mechanism is provided to prevent the roller 22 from disengaging from the wedging device 32, such as a stop member on the mounting bracket 20 which limits rotation of arm 18. Such variations are not to be regarded as a departure from the spirit and scope of the invention, and all such modifications as would be obvious to one skilled in the art are intended to be included within the scope of the following claims.

What is claimed is:

1. A vehicle door checkstrap assembly, comprising:

a channel including first and second sides at a distance from each other, said channel adapted to be fixedly attached to one of an automobile frame member and a closure member;

an arm having a first and a second end where the first end is disposed in said channel, said second end of said arm being pivotally mounted to a mounting bracket, said mounting bracket adapted to be fixedly attached to the other of said frame member and said closure member;

a spring device biasing said arm toward one of the first and second sides of the channel;

a roller attached to said first end of said arm; and a wedging assembly disposed in said channel between the roller and the one of the first and second sides of the channel.

2. The vehicle door checkstrap assembly of claim 1, wherein said spring device biases said roller toward said first side of said channel.

3. The vehicle door checkstrap assembly of claim 2, wherein said wedging assembly comprises:

a first roller rotatably attached to a connector and a second roller rotatably attached to said connector spaced apart from said first roller.

4. The vehicle door checkstrap assembly of claim 3, wherein said roller is disposed between said first and second rollers of said wedging device.

5. The vehicle door checkstrap assembly of claim 4, wherein a force applied to said arm displaces said roller from a first position disposed against said first side of said channel to a second position wherein said roller is in contact with said second side of said channel.

6. A vehicle comprising:

a body frame member defining a door opening and a door pivotally mounted to said body frame member;

a channel including first and second sides at a distance from each other, said channel fixedly attached to one of said body frame member and said door;

an arm having a first and second end wherein said first end is disposed in said channel, said second end of said arm being pivotally mounted to a mounting bracket, said mounting bracket fixedly attached to the other of said body frame member and said door;

a roller attached to said first end of said arm;

a spring device biasing said arm such that said roller is biased toward said first side of said channel; and a wedging assembly disposed in said channel between the roller and the first side of the channel.

7. The vehicle of claim 6, wherein said wedging assembly comprises:

a first roller rotatably attached to a connector and a second roller rotatably attached to said connector spaced apart from said first roller.

8. The vehicle of claim 7, wherein said roller is disposed between said first and second rollers of said wedging assembly.

9. The vehicle of claim 6, wherein a force applied to said arm displaces said roller from a first position disposed against said wedging assembly to a second position wherein said roller is in contact with said second side of said channel.

10. A door check assembly, comprising:

a guide structure including a surface attached to one of frame member and a closure member;

an arm having a first and second end, said second end of said arm being pivotally mounted to a mounting bracket, said mounting bracket adapted to be fixedly attached to the other of said frame member and said closure member;

a biasing device for biasing said arm toward said surface;

a roller attached to said first end of said arm;

a wedging assembly disposed between said roller and said surface of said guide structure; and means for preventing said roller from disengaging from said wedging assembly.

11. The vehicle door checkstrap assembly of claim 10, wherein said wedging assembly comprises:

a first wedge roller rotatably attached to a connector and a second wedge roller rotatably attached to said connector spaced apart from said first roller.

12. The vehicle door checkstrap assembly of claim 11, wherein said roller is disposed between said first and second wedge rollers of said wedging device.

13. The vehicle door checkstrap assembly of claim 12, wherein a force applied to said arm displaces said roller from a first position disposed against said connector to a second position wherein said roller is in contact with one of said first and second wedge rollers.

14. A vehicle door checkstrap comprising:

a channel including first and second sides at a distance from each other, said channel adapted to be fixedly attached to one of an automobile frame member and a closure member;

an arm having a first and second end where the first end is disposed in said channel, said second end of said arm being pivotally mounted to a mounting bracket, said mounting bracket adapted to be fixedly attached to the other of said frame member and said closure member;

a spring device biasing said arm toward said first side of said channel;

a roller attached to said first end of said arm; and a wedging assembly disposed in said channel in association with said roller, the wedging assembly comprising a first wedge roller rotatably attached to a connector and a second wedge roller rotatably attached to said connector spaced apart from said first wedge roller, said roller disposed between said first and second wedge rollers.

15. The vehicle door checkstrap assembly of claim 14 wherein a force applied to said arm displaces said roller from a first position disposed against said first side of said channel to a second position wherein said roller is in contact with said second side of said channel.

16. A vehicle comprising:

a body frame member defining a door opening and a door pivotally mounted to said body frame member;

a channel including first and second sides at a distance from each other, said channel fixedly attached to one of said body frame member and said door;

an arm having a first and second end wherein said first end is disposed in said channel, said second end of said arm being pivotally mounted to a mounting bracket, said mounting bracket fixedly attached to the other of said body frame member and said door;

a roller attached to said first end of said arm;

a spring device biasing said arm such that said roller is biased toward said first side of said channel; and a wedging assembly disposed in said channel in association with said roller, the wedging assembly comprising a first wedge roller rotatably attached to a connector and a second wedge roller rotatably attached to said connector spaced apart from said first wedge roller, said roller disposed between said first and second wedge rollers.

17. A vehicle of claim 16 wherein a force applied to said arm displaces said roller from a first position disposed against said first side of said channel to a second position wherein said roller is in contact with said second side of said channel.

18. A vehicle door checkstrap assembly comprising:

a support surface adapted to be coupled to one of an automobile frame member and a closure member;

an arm having a first end coupled to a roller and a second end pivotally mounted to the other of the frame member and the closure member;

a wedging assembly disposed between the roller and the support surface; and a biasing device urging the arm and the roller toward the support surface with a predetermined force, whereby the wedging device prevents the roller from moving along the support surface until a force sufficient to overcome the predetermined force is applied to the arm.

* * * * *